US010801669B2

(12) United States Patent
Herbert et al.

(10) Patent No.: US 10,801,669 B2
(45) Date of Patent: Oct. 13, 2020

(54) VESSEL INCLUDING INSULATING CORNER BLOCKS PROVIDED WITH STRESS RELIEF SLOTS

(71) Applicant: GAZTRANSPORT ET TECHNIGAZ, Saint Remy les Chevreuse (FR)

(72) Inventors: Alexandre Herbert, Saint Denis (FR); Julien Couteau, Bressuire (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 208 days.

(21) Appl. No.: 15/743,202

(22) PCT Filed: Oct. 21, 2016

(86) PCT No.: PCT/FR2016/052743
§ 371 (c)(1),
(2) Date: Jan. 9, 2018

(87) PCT Pub. No.: WO2017/068303
PCT Pub. Date: Apr. 27, 2017

(65) Prior Publication Data

US 2019/0120430 A1 Apr. 25, 2019

(30) Foreign Application Priority Data

Oct. 23, 2015 (FR) ..... 15 60149

(51) Int. Cl.
*F17C 3/02* (2006.01)
*B63B 25/16* (2006.01)
(Continued)

(52) U.S. Cl.
CPC ..... *F17C 3/027* (2013.01); *B63B 25/16* (2013.01); *B63B 27/25* (2013.01); *F17C 6/00* (2013.01);
(Continued)

(58) Field of Classification Search
None
See application file for complete search history.

(56) References Cited

FOREIGN PATENT DOCUMENTS

FR 2 996 520 A1 4/2014
FR 3 001 945 A1 8/2014
(Continued)

OTHER PUBLICATIONS

International Search Report for PCT/FR2016/052743 filed on Oct. 21, 2016.

*Primary Examiner* — Daphne M Barry
(74) *Attorney, Agent, or Firm* — Notaro, Michalos & Zaccaria P.C.

(57) ABSTRACT

A sealed and thermally-insulating fluid storage tank includes an angle arrangement placed at the intersection between the first and the second walls. The storage tank also includes a first and a second insulating blocks respectively retained on the first and second walls of the supporting structure and forming a corner of the thermally insulating barrier; and a metal angle structure forming a corner of the sealing membrane which is welded onto the plurality of metal plates of the first and second insulating blocks. Each of the first and second insulating blocks is associated with an adjacent insulating panel via a bridging element. Each of the first and second insulating blocks has at least one first and one second stress-relief slots extending respectively parallel and at right angles to the intersection between the first and the second walls.

15 Claims, 7 Drawing Sheets

(51) Int. Cl.
*B63B 27/25* (2006.01)
*F17C 6/00* (2006.01)

(52) U.S. Cl.
CPC ..... *F17C 2201/0157* (2013.01); *F17C 2201/052* (2013.01); *F17C 2203/035* (2013.01); *F17C 2203/0329* (2013.01); *F17C 2203/0341* (2013.01); *F17C 2203/0358* (2013.01); *F17C 2203/0631* (2013.01); *F17C 2205/0352* (2013.01); *F17C 2221/033* (2013.01); *F17C 2221/035* (2013.01); *F17C 2223/0153* (2013.01); *F17C 2223/0161* (2013.01); *F17C 2223/033* (2013.01); *F17C 2227/0135* (2013.01); *F17C 2260/011* (2013.01); *F17C 2270/0107* (2013.01)

(56) References Cited

FOREIGN PATENT DOCUMENTS

| | | | |
|---|---|---|---|
| WO | 2014/167206 | A1 | 10/2014 |
| WO | 2014/167214 | A2 | 10/2014 |
| WO | 2017/006044 | A1 | 1/2017 |

VESSEL INCLUDING INSULATING CORNER BLOCKS PROVIDED WITH STRESS RELIEF SLOTS

TECHNICAL FIELD

The invention relates to the field of the tanks, sealed and thermally insulating, with membranes, for storing and/or transporting a fluid, such as a cryogenic fluid.

Sealed and thermally insulating tanks with membranes are employed in particular for storing liquefied natural gas (LNG), which is stored, at atmospheric pressure, at approximately −162° C. These tanks can be installed onshore or on a floating structure. In the case of a floating structure, the tank may be intended to transport liquefied natural gas or to receive liquefied natural gas used as fuel to propel the floating structure.

Technological Background

The document WO2014167214 describes a sealed and thermally insulating tank whose walls have a multilayer structure comprising, in succession, in the direction of the thickness, from the outside to the inside of the tank, a secondary thermally insulating barrier comprising insulating panels anchored to the supporting structure, a secondary sealing membrane supported by the insulating panels of the secondary thermally insulating barrier, a primary thermally insulating barrier comprising insulating panels anchored to the secondary thermally insulating barrier and a primary sealing membrane, intended to be in contact with the liquefied natural gas contained in the tank, which is supported by the insulating panels of the primary thermally insulating barrier.

At an intersection between two walls of the tank, the secondary thermally insulating barrier comprises a first and a second insulating blocks forming a corner of said secondary thermally insulating barrier. In this zone, the secondary sealing membrane comprises a metal angle structure which comprises two metal strips which are respectively welded onto metal plates supported by one and the other of the first and second insulating blocks and a metal angle iron which is lap-welded onto the two metal strips so as to ensure the continuity of the seal in the angle zone. Given the thermal contraction of the angle structure of the secondary sealing membrane, the insulating blocks are subject to significant stresses which are located in the zones in which the metal plates are fixed. Such stress levels are likely to cause cracking of said insulating blocks when the tank is made cold, that is to say when the tank is filled with liquefied natural gas.

Also, the insulating blocks of the angle zone and the insulating panels of the thermally insulating barriers have a tendency to shrink such that they separate from one another. Now, such a separation causes significant stresses on the sealing membranes. Furthermore, this separation stresses the secondary sealing membrane all the more when the latter is sandwiched between the insulating panels of the secondary thermally insulating barrier and those of the primary thermally insulating barrier and the separation of the insulating panels therefore generates frictions of the secondary sealing membrane against the insulating panels of the primary and secondary thermally insulating barriers.

The tank described in the document WO2014167214 mentioned above is not therefore fully satisfactory.

SUMMARY

One idea on which the invention is based is to propose a sealed and thermally insulating tank which is particularly reliable and resistant to the low temperatures, in particular at the intersection between two walls of the supporting structure.

Another idea on which the invention is based is to introduce flexibility in the angle insulating blocks in order to compensate for the contraction of a metal angle structure, in particular when it is continuous without waves.

According to one embodiment, the invention provides a sealed and thermally-insulating fluid storage tank comprising at least one thermally insulating barrier retained on a supporting structure and a sealing membrane supported by said thermally insulating barrier, the thermally insulating barrier comprising a plurality of insulating panels retained on the supporting structure and juxtaposed against at least one first and one second adjacent walls of the supporting structure;

the tank further comprising an angle arrangement placed at the intersection between the first and the second walls and comprising:

- a first and a second insulating blocks respectively retained on the first and second walls of the supporting structure and forming a corner of the thermally insulating barrier; each of the first and second insulating blocks comprising an outer face placed facing the supporting structure and an inner face comprising metal plates spaced apart from one another along the intersection between the first and the second walls; said first and second insulating blocks comprising a layer of polymer foam; and
- a metal angle structure forming a corner of the sealing membrane and comprising a first and a second wings which are respectively welded onto the plurality of metal plates of the first and second insulating blocks; each of the first and second insulating blocks being associated with an adjacent panel of the plurality of insulating panels via a bridging element; said bridging element being fixed straddling an edge, parallel to the intersection, of the inner face of said first or second insulating block and an inner face of the adjacent panel, so as to oppose a mutual separation of said first or second insulating block and of said adjacent panel;

each of the first and second insulating blocks having at least one first and one second stress-relief slots formed in the inner face of said first or second insulating block in the thickness of the layer of polymer foam; the first stress-relief slot extending parallel to the intersection, said first stress-relief slot being situated so as to pass between the edge of the inner face of the insulating block receiving the bridging element and the plurality of metal plates of said insulating block; the second stress-relief slot extending at right angles to the intersection, said second stress-relief slot being situated so as to pass between the first and the second walls, between two of the metal plates of said insulating block.

Thus, the bridging elements ensure a mechanical connection between the insulating blocks and the adjacent insulating panels, which prevents the mutual separation thereof such that the sealing membrane is less stressed than those of the tanks of the prior art, notably when the tank is made cold.

Furthermore, by virtue of the presence of at least one stress-relief slot at right angles to the intersection, the stresses that are exerted on the insulating blocks of the angle structure because of the contraction of the metal angle structure in the direction parallel to the intersection are better distributed.

Finally, by virtue of the stress-relief slot parallel to the intersection, the stresses that are exerted on the insulating blocks because of the presence of bridging elements fixed straddling each insulating block and an adjacent panel and of the contraction of the angle iron in the direction at right angles to the intersection are also reduced.

According to embodiments, such a sealed and thermally insulating tank for storing a fluid can comprise one or more of the following features:

- The bridging element is placed between the sealing membrane and the supporting structure.
- The first and second insulating blocks each comprise an inner plywood sheet and an outer plywood sheet respectively defining the inner face and the outer face of said first and second panels and a layer of insulating polymer foam sandwiched between said inner and outer plywood sheets.
- Each of the first and second insulating blocks comprises a series of stress-relief slots extending at right angles to the intersection between the first and the second walls, each of said stress-relief slots being situated in a respective interval between two of the metal plates of said insulating block.
- The stress-relief slots at right angles to the intersection are evenly distributed along the intersection.
- The series of stress-relief slots extending at right angles to the intersection comprises at least one central stress-relief slot and two end stress-relief slots which extend on either side of the central stress-relief slot, the central stress-relief slot having a depth greater than that of each of the end stress-relief slots.
- The stress-relief slots at right angles to the edge have depths that are different from one another. The depth of the stress-relief slots decreases from the central stress-relief slot to the end stress-relief slots, that is to say when moving away from the center of the panel to approach one or other of the lateral edges of the insulating block. Such an arrangement makes it possible to reduce the flexibility of the panel on its edges and increase it in its central zone and consequently obtain a better distribution of the stresses within each insulating block.
- According to one embodiment, the or each stress-relief slot extending at right angles to the intersection extends from an edge of the insulating block which is adjacent to the intersection up to the first stress-relief slot. In other words, the stress-relief slots at right angles to the intersection emerge in the first stress-relief slot.
- According to another embodiment, the or each stress-relief slot at right angles to the intersection stops before joining the first stress-relief slot.
- The first and the second insulating blocks are respectively retained on the first and the second walls of the supporting structure by means of a plurality of studs fixed to the supporting structure, each of said first and second insulating blocks being provided with cylindrical wells in each of which is anchored one of the threaded studs; said cylindrical wells being formed along the edge of said insulating block adjacent to an insulating panel.
- The metal angle structure comprises an angle iron and a pair of metal strips lap-welded with the angle iron, one of the angle iron and the pair of metal strips being welded onto the plurality of the metal plates of the first and of the second insulating blocks.
- The wings of the metal angle structure are planar. In other words, the angle structure has no corrugations.
- The insulating panels have an inner face equipped with metal plates, the sealing membrane comprising a plurality of corrugated metal sheets which are welded onto the metal plates of the insulating panels and the angle structure being connected by tight welding to the corrugated metal sheets.
- The corrugations of the corrugated metal sheets protrude toward the interior or toward the exterior of the tank.
- The bridging elements are bridging plates which each have an outer face resting against the inner face of the first or of the second insulating block and the inner face of the adjacent panel and an inner face supporting the sealing membrane.
- The inner face of the insulating blocks and the inner face of each adjacent panel each comprise a setback in which one of the bridging plates is fixed.
- The bridging plates are fixed by gluing, screwing and/or stapling against the inner face of the insulating block and of the adjacent insulating panel.
- The thermally insulating barrier is a secondary thermally insulating barrier and the sealing membrane is a secondary sealing membrane, the tank further comprising a primary thermally insulating barrier anchored to the secondary thermally insulating barrier by retaining members and a primary sealing membrane supported by the primary thermally insulating barrier and intended to be in contact with the fluid contained in the tank.
- The angle arrangement comprises primary insulating blocks forming a corner of the primary thermally insulating barrier which are each retained against one or other of the first and second insulating blocks by means of studs supported by the metal plates of the first and second insulating blocks.
- The metal angle structure comprises orifices through which pass the studs supported by the metal plates of the first and second insulating blocks, the metal angle structure being welded to said metal plates at the periphery of said orifices.
- The primary thermally insulating barrier comprises a plurality of insulating panels retained on the insulating panels of the secondary thermally insulating barrier.
- According to one embodiment, the corrugations of the corrugated metal sheets of the secondary sealing membrane protrude toward the interior of the tank, the primary thermally insulating barrier comprising insulating panels each having an outer face having right-angled grooves receiving the corrugations of the corrugated metal sheets of the secondary sealing membrane.

Such a tank can form part of an onshore storage installation, for example for storing LNG, or be installed in a floating, coastal and/or deep water structure, in particular an ethane or methane ship, a floating storage and regasification unit (FSRU), a floating production, storage and offloading (FPSO) unit and the like. In the case of a floating structure, the tank can be intended to receive liquified natural gas used as fuel to propel the floating structure.

According to one embodiment, a ship for transporting a fluid comprises a hull, such as a double hull, and an abovementioned tank placed in the hull.

According to one embodiment, the invention also provides a method for loading or offloading such a ship, in which a fluid is routed through insulated pipelines from or to a floating or onshore storage installation to or from the tank of the ship.

According to one embodiment, the invention also provides a transfer system for a fluid, the system comprising the abovementioned ship, insulated pipelines arranged so as to link the tank installed in the hull of the ship to a floating or onshore storage installation and a pump for driving a flow of fluid through the insulated pipelines from or to the floating or onshore storage installation to or from the tank of the ship.

BRIEF DESCRIPTION OF THE FIGURES

The invention will be better understood, and other aims, details, features and advantages thereof will become more clearly apparent from the following description of particular embodiments of the invention, given purely in an illustrative and nonlimiting manner, with reference to the attached drawings.

DETAILED DESCRIPTION OF EMBODIMENTS

By convention, the terms "outer" and "inner" are used to define the relative position of one element in relation to another, by referring to the interior and the exterior of the tank.

Figure 1:
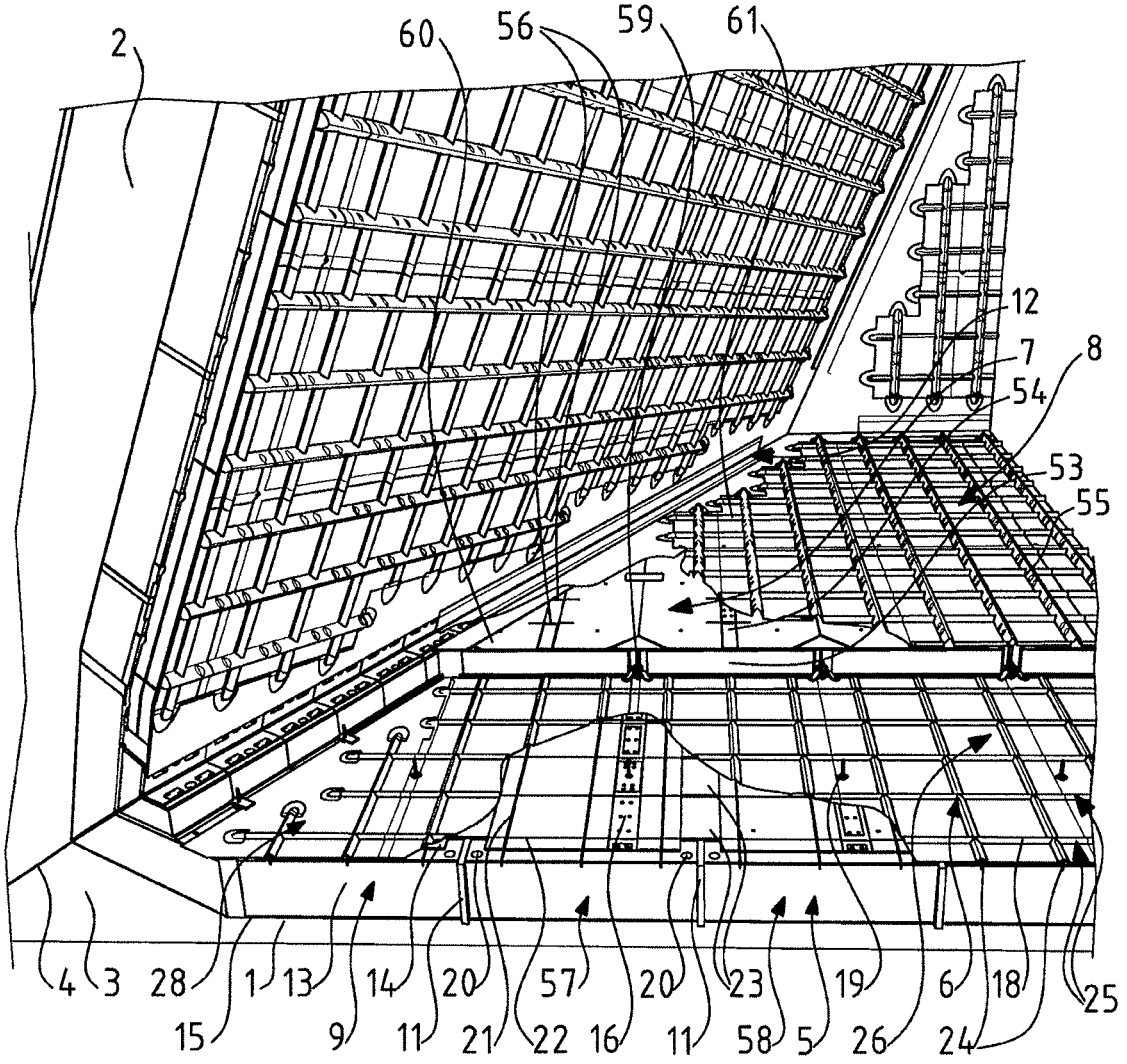
FIG. 1 is a cutaway perspective view of an intersection between two walls of a sealed and thermally insulating tank.

In relation to FIG. 1, the multilayer structure of a sealed and thermally insulating tank for storing a cryogenic fluid, such as liquefied natural gas, is observed at the intersection between two adjacent walls 1, 2 of a supporting structure 3. The two adjacent walls of the supporting structure meet at a rectilinear edge 4.

In the case of FIG. 1, the edge 4 is located at the intersection of a bottom wall 1 and of a longitudinal wall 2 which converges toward the point of a confined space in a ship, such as the front end of the ship or a hold close to the engine.

Each wall of the tank comprises, from the outside to the inside of the tank, a secondary thermally insulating barrier 5 anchored to the supporting structure 3 by secondary retaining members, a secondary sealing membrane 6 supported by the secondary thermally insulating barrier 5, a primary thermally insulating barrier 7 anchored to the secondary thermally insulating barrier 6 by primary retaining members and a primary sealing membrane 8, supported by the primary thermally insulating barrier 7 and intended to be in contact with the liquefied natural gas contained in the tank.

The supporting structure 3 can in particular be formed by self-supporting metal sheets or, more generally, any type of rigid partition exhibiting appropriate mechanical properties. The supporting structure 3 can in particular be formed by the hull or the double hull of a ship. The supporting structure 3 comprises a plurality of walls 1, 2 defining the general form of the tank, usually a polyhedral form.

The secondary thermally insulating barrier 5 comprises a plurality of insulating panels 9, 57, 58 anchored to the supporting structure 3 by means of resin beads, not illustrated, and/or studs welded to the supporting structure 3.

In a standard zone of a tank wall, the insulating panels 57, 58 have substantially a rectangular parallelepipedal form and are juxtaposed in parallel rows and separated from one another by interstices guaranteeing a functional mounting play. The insulating panels 57, 58 for example have a length of 3 m and a width of 1 m. The interstices are filled with a heat insulating lining 11, such as glass wool, rock wool or open-cell flexible synthetic foam, for example. The heat insulating lining is advantageously produced in a porous material so as to form gas flow spaces in the interstices between the insulating panels 57, 58.

Figure 2:
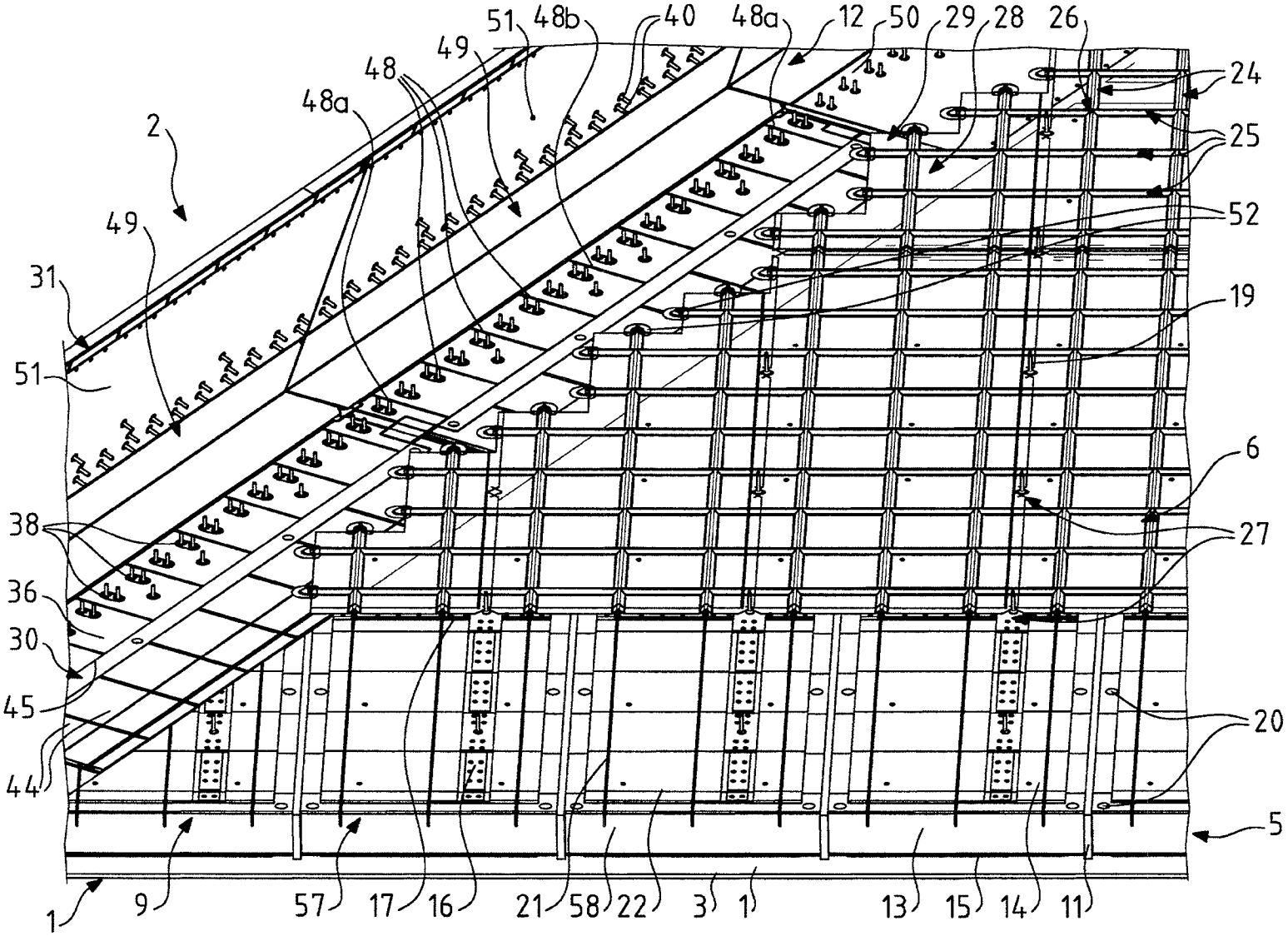
FIG. 2 is a cutaway perspective view illustrating the secondary thermally insulating barrier and the secondary sealing membrane of the tank of FIG. 1 at the intersection between two walls.

Moreover, depending on the form of the wall to be covered, the insulating panels 9, which run along an angle arrangement 12 placed at the intersection between two walls 1, 2, can have either a rectangular parallelepipedal form or a different form, for example a trapezoid or right-angled triangle form, as represented along the intersection between the two walls in FIGS. 1 and 2.

The insulating panels 9, 57, 58 each comprise a layer of insulating polymer foam 13 sandwiched between an inner rigid sheet 14 and an outer rigid sheet 15. The inner 14 and outer 15 rigid sheets are, for example, sheets of plywood glued onto said layer of insulating polymer foam 13. The insulating polymer foam 13 can in particular be a polyurethane-based foam. The insulating polymer foam 13 is advantageously reinforced by glass fibers contributing to reducing its thermal contraction coefficient.

The inner sheet 14 is equipped with metal plates 16, 17 for anchoring the edge of corrugated metal sheets 18 of the secondary sealing membrane 6 on the insulating panels 9, 57, 58. As represented in FIG. 2, the metal plates 16, 17 extend in two right-angled directions which are each parallel to at least one of the sides of the insulating panel 9, 57, 58 onto which said metal plates 16, 17 are fixed. The metal plates 16, 17 are fixed onto the inner sheet 14 of the insulating panel 9, 57, 58, by screws, rivets or staples, for example. The metal plates 16, 17 are fitted in voids formed in the inner sheet 14 such that the inner surface of the metal plates 16, 17 is flush with the inner surface of the inner sheet 14.

The inner sheet 14 is also equipped with threaded studs 19 protruding toward the interior of the tank, and intended to ensure the fixing of the primary thermally insulating barrier 7 onto the insulating panels 9, 57, 58 of the secondary thermally insulating barrier 5.

In order to ensure the fixing of the insulating panels 9, 57, 58 to studs fixed to the supporting structure 3, the insulating panels 9, 57, 58 are provided with cylindrical wells 20, represented in FIGS. 1 and 2, passing right through the insulating panels 9, 57, 58. The cylindrical wells 20 are formed along longitudinal edges of said insulating panels 9, 57, 58 and at the corners thereof. The cylindrical wells 20 exhibit a change of section, not illustrated, defining bearing surfaces for nuts cooperating with the threaded ends of the studs.

As represented in FIGS. 1 and 2, the inner sheet 14 of the insulating panels 9, 57, 58 has two series of stress-relief slots 21, 22, at right angles to one another, so as to form a network of stress-relief slots. The stress-relief slots 21, 22 extend here from one end to the other of the panel, either over its entire length, or over its entire width. The stress-relief slots 21, 22 pass right through the thickness of the inner sheet 14 and are also formed in a part of the thickness of the layer of insulating polymer foam 13. Each of the stress-relief slots 21, 22 extends facing one of the corrugations of the secondary sealing membrane 6. By virtue of said stress-relief slots 21, 22, the corrugations of the secondary sealing membrane 6 can be deformed without imposing significant mechanical stresses on the insulating panels 9, 57, 58.

Moreover, the inner sheet 14 has, along its edges, in each interval between two successive stress-relief slots 21, 22, a setback receiving bridging plates 23, illustrated in FIG. 1. The bridging plates 23 are each placed straddling two adjacent insulating panels, spanning the interstice between the insulating panels 9, 57, 58. Each bridging plate 23 is fixed against each of the two adjacent insulating panels 9, 57, 58 so as to oppose the mutual separation thereof. The bridging plates 23 have a rectangular parallelepipedal form and are for example formed by a sheet of plywood. The outer face of the bridging plates 23 is fixed against the bottom of the setbacks. The depth of the setbacks is substantially equal to the thickness of the bridging plates 23 such that the inner face of the bridging plates 23 comes substantially level with the other planar zones of the inner sheet 14. Thus, the bridging plates 23 are able to ensure a continuity in the bridging of the secondary sealing membrane 6.

So as to ensure a good distribution of the link loads between the adjacent panels 9, 57, 58, a plurality of bridging plates 23 extends along each edge of the inner sheet 14 of the insulating panels 9, 57, 58, a bridging plate 23 being placed in each interval between two neighboring stress-relief slots 21, 22 of a series of parallel stress-relief slots. The bridging plates 23 can be fixed against the inner sheet 14 of the insulating panels 9, 57, 58 by any appropriate means. It has however been found that the combination of the application of a glue between the outer face of the bridging plates 23 and the inner sheet 14 of the insulating panels 9, 57, 58 and of the use of mechanical fixing members, such as staples, making it possible to apply pressure on the bridging plates against the insulating panels, was particularly advantageous.

The secondary sealing membrane 6 comprises a plurality of corrugated metal sheets 18 each having a substantially rectangular form, in a standard zone of the wall. The corrugated metal sheets 18 are placed offset in relation to the insulating panels 9, 57, 58 of the secondary thermally insulating barrier 5 such that each of said corrugated metal sheets 18 extends jointly over four adjacent insulating panels 9, 57, 58. Each corrugated metal sheet 18 has a first series of parallel corrugations 24 extending in a first direction and a second series of parallel corrugations 25 extending in a second direction. The directions of the two series of corrugations are at right angles. Each of the series of corrugations 24, 25 is parallel to two opposite edges of each corrugated metal sheet 18. The corrugations 24, 25 here protrude toward the interior of the tank, that is to say in the direction away from the supporting structure 3. However, in another alternative embodiment not represented, the corrugations 24, 25 protrude toward the exterior of the tank.

Each corrugated metal sheet 18 comprises, between the corrugations, a plurality of planar surfaces. At each intersection between two corrugations 24, 25, each metal sheet 18 comprises a node zone 26 having an apex protruding toward the interior of the tank. The adjacent corrugated metal sheets 18 are lap-welded together. The anchoring of the corrugated metal sheets 18 on the metal plates 16, 17 is produced by spot welds.

As represented in FIG. 2, the corrugated metal sheets 18 comprise, along their longitudinal edges and at their four corners, cutouts 27 allowing the passage of the studs 19 intended to ensure the fixing of the primary thermally insulating barrier 6 onto the secondary thermally insulating barrier 5.

The corrugated metal sheets 18 are, for example, produced in Invar®: that is to say an alloy of iron and nickel whose coefficient of expansion typically lies between $1.2.10^{-6}$ and $2.10^{-6}$ $K^{-1}$, or in an iron alloy with high manganese content whose coefficient of expansion is typically of the order of $7.10^{-6}$ $K^{-1}$. Alternatively, the corrugated metal sheets 18 can also be produced in stainless steel or in aluminum.

Depending on the form of the wall to be covered, the corrugated metal sheets 28 running along an angle arrangement 12 placed at the intersection between two walls 1, 2 can have a substantially rectangular form, or a generally right-angled triangular form as represented in FIG. 2. In such a case, the hypotenuse 29 of the right-angled triangle is oriented parallel to the intersection between the two walls 2, 3 and has a serrated form.

With respect to FIGS. 3 to 7, there now follows a description of the secondary thermally insulating barrier 5 at an angle arrangement 12 placed at the intersection between two adjacent walls 1, 2 of the supporting structure 3.

The angle arrangement 12 comprises a plurality of pairs of insulating blocks 30, 31 which are respectively placed against one and the other of the two adjacent walls 1, 2 of the supporting structure 3 and thus form a corner of the secondary thermally insulating barrier 5. The two insulating blocks 30, 31 each have a beveled edge 32 by which said two insulating blocks 30, 31 are fixed to one another, for example by gluing. It will be appreciated that the angle formed between the two insulating blocks 30, 31 must correspond to the angle between the two walls 1, 2 of the supporting structure 3. This angle can vary according to the zone of the tank that is being considered, typically between 90° and 135°. In the particular case of FIG. 1, the angle is even tighter around 70°.

Figure 12:
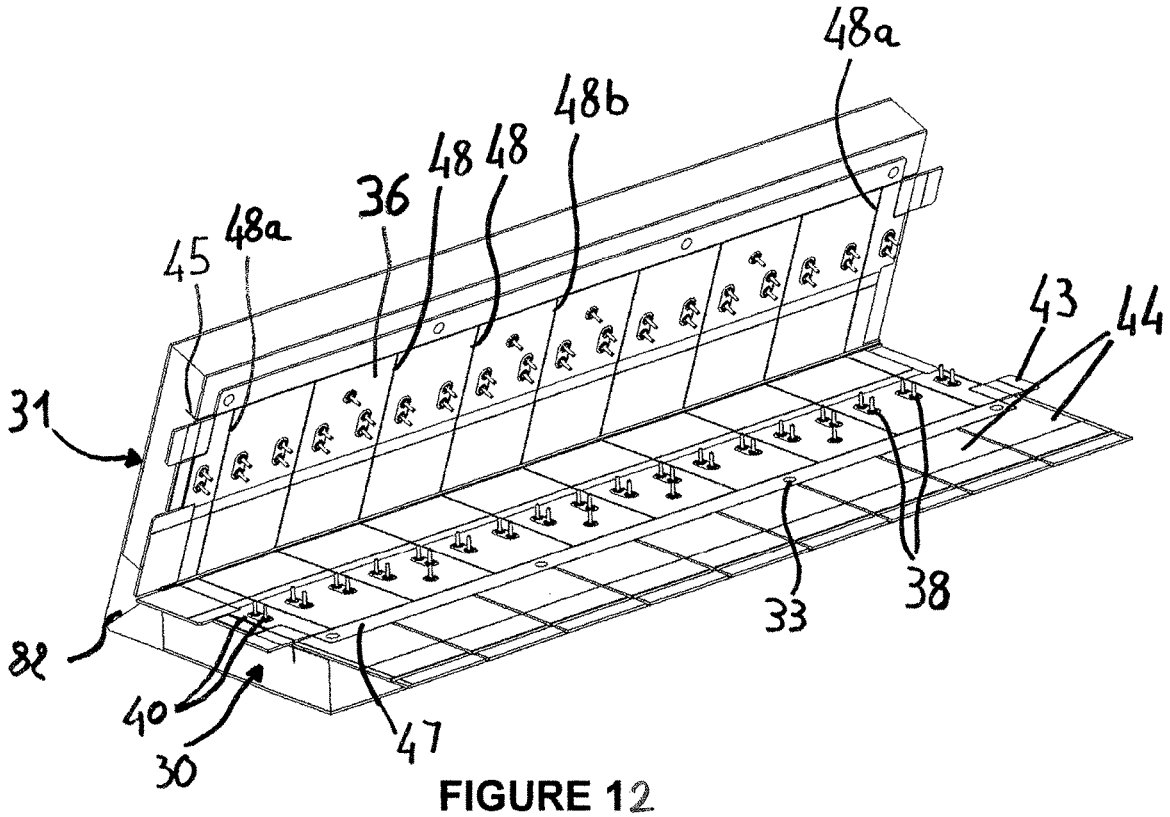
FIG. 12 is a view similar to that of FIG. 3 representing insulating blocks forming a corner of the secondary thermally insulating barrier according to another embodiment.
Figure 13:
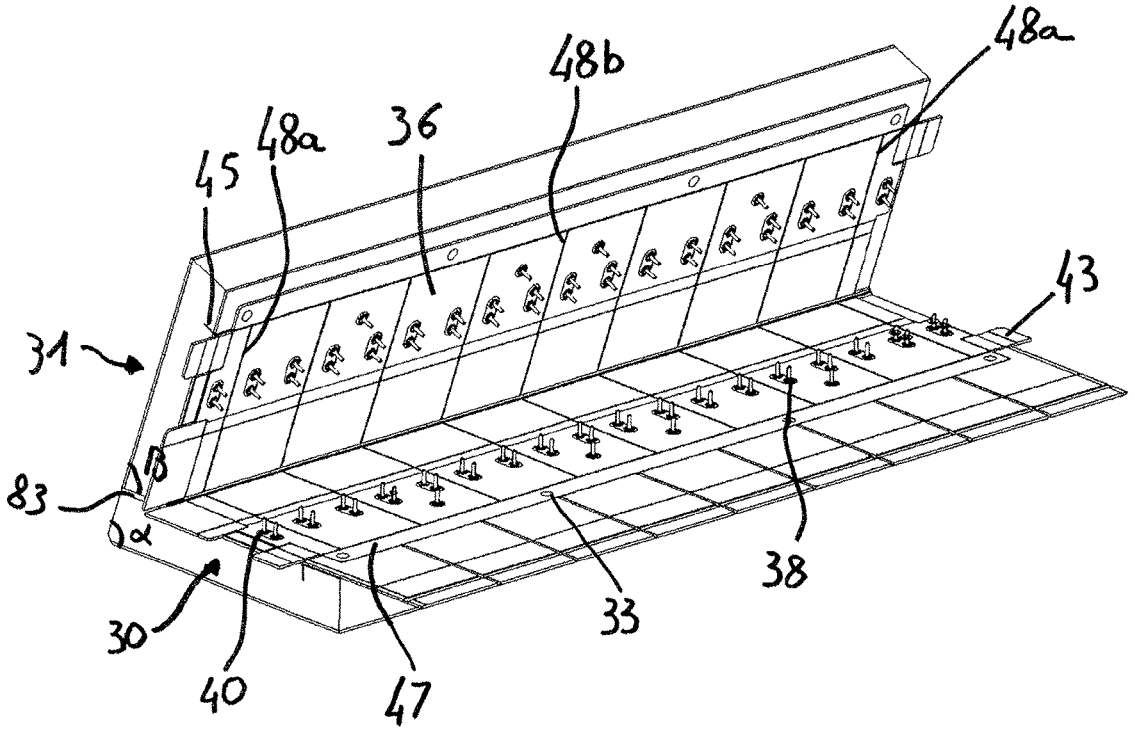
FIG. 13 is a view similar to those of FIGS. 3 and 12 and representing yet another embodiment.

According to other embodiments represented in particular in FIGS. 12 and 13, the arrangement of the pair of insulating blocks 30, 31 can be slightly different.

In the embodiment represented in FIG. 12, the two insulating blocks 30, 31 do not have any beveled edge. Also, in this embodiment, an L-shaped heat-insulating lining 82, such as glass wool, rock wool or open-cell flexible synthetic foam, for example, is positioned in the angle between the two insulating blocks in order to ensure the continuity of the secondary thermally insulating barrier in the angle zone.

In the embodiment represented in FIG. 13, the edge turned toward the edge of one of the insulating blocks 31 rests against the inner face of the other insulating block 30, optionally with the interposition of a flexible heat-insulating lining 83, in order to form a corner of the secondary thermally insulating barrier. In such a case, the edge turned toward the edge of the insulating block 30 must be cut so as to form, with the outer face of said insulating block 30, an angle $\alpha$ substantially equal to the angle formed between the two walls 1, 2. Likewise, the edge turned toward the edge of the other insulating block 30 should form, with the inner face of said insulating block 30, an angle $\beta$ which is also substantially equal to the angle formed between the two walls 1, 2.

Returning to FIG. 3, it can be seen that the insulating blocks 30, 31 have a structure similar to that of the insulating panels 9, 57, 58 of the secondary thermally insulating barrier 5, namely a sandwich structure consisting of a layer of insulating polymer foam 34 sandwiched between two outer 35 and inner 36 rigid sheets, for example of plywood.

The insulating blocks 30, 31 of the angle arrangement are fixed onto the supporting structure 3 using threaded studs welded to the supporting structure 3. For this, each of the insulating blocks 30, 31 is provided with cylindrical wells 33 which are each intended to receive one of the threaded studs. The cylindrical wells 33 are distributed along the edge of the insulating blocks 30, 31 which is parallel and opposite to the edge 4 of the angle. Each cylindrical well 30 exhibits a change of section defining a bearing surface for a nut receiving the threaded end of the stud. According to a preferred embodiment, each cylindrical well 30 changes section at the interface between the outer sheet 36 and the layer of insulating polymer foam 35 such that the nut comes to bear against the outer sheet 36.

Figure 5:
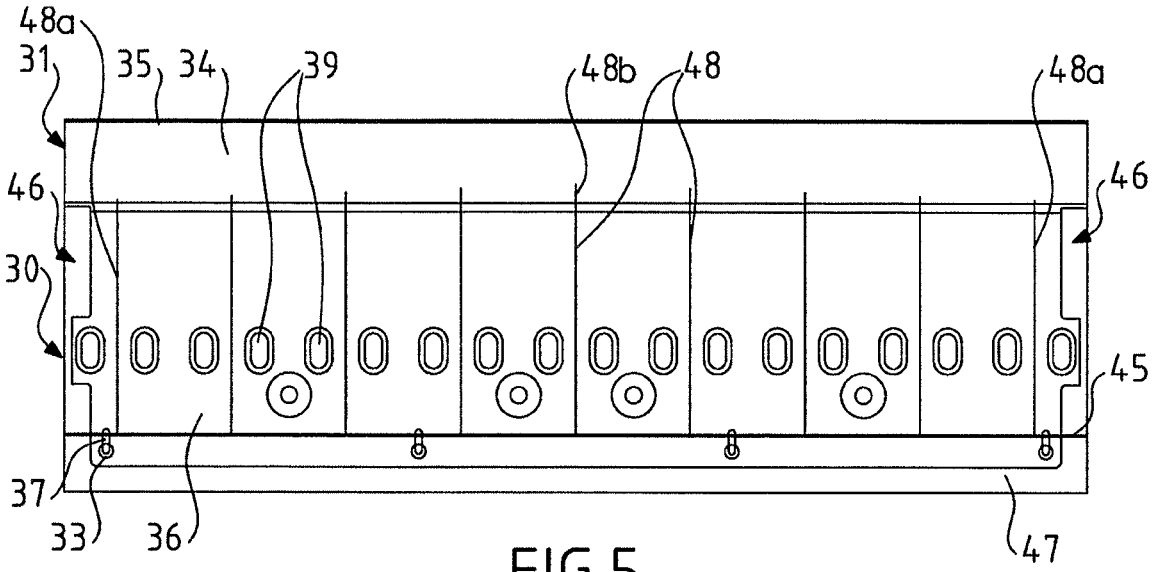
FIG. 5 is a plan view of the insulating blocks of the angle arrangement of FIG. 3 which form a corner of the secondary thermally insulating barrier.
Figure 6:
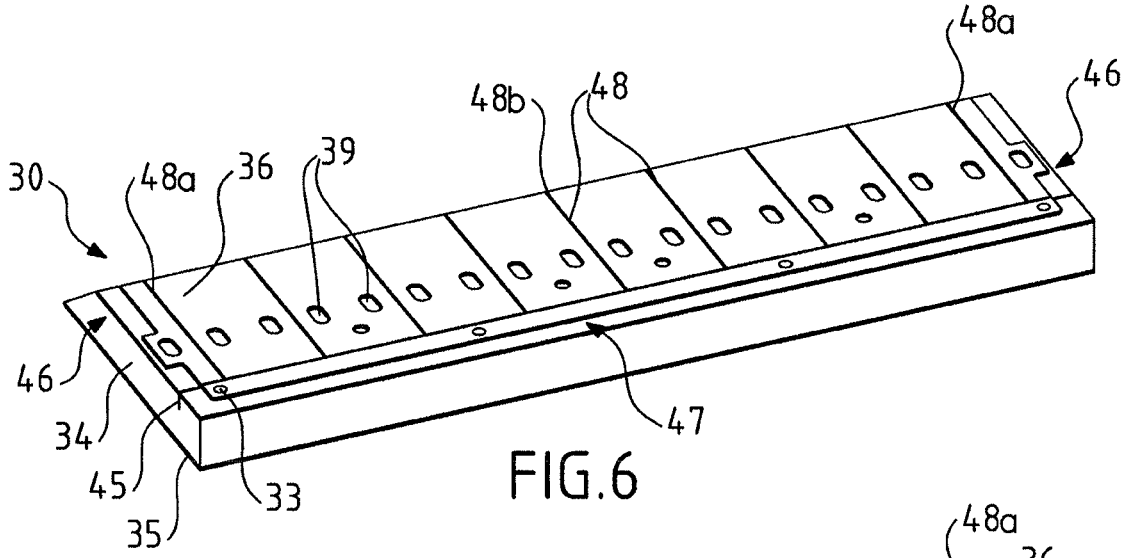
FIG. 6 is a perspective view of one of the insulating blocks illustrated in FIG. 5.
Figure 7:
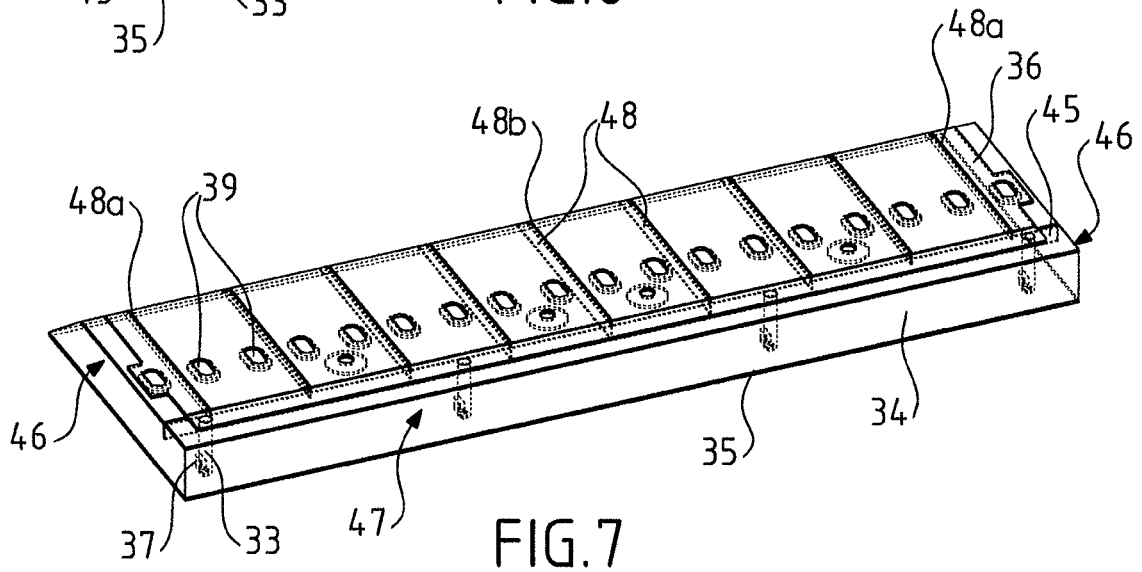
FIG. 7 is a perspective view of the insulating block of FIG. 6 in which said insulating block is represented as transparent, so as to allow the stress-relief slots to be seen.

In relation to FIGS. 5 and 7, it can be observed that each insulating block 30, 31 has, on its outer face, a plurality of oblong recesses 37 which extend at right angles to the edge 4 of the angle. The oblong recesses 37 each emerge in one of the cylindrical wells 30 and are positioned toward the edge 4 of the angle in relation to said cylindrical well 30. The oblong recesses 37 have a greater length oriented at right angles to the edge 4. The oblong recesses 37 are formed through the outer sheet 35 and through a bottom portion of the layer of insulating polymer foam 34 and have a depth allowing the passage of the end of the stud. Thus, the oblong recesses 37 make it possible to form a mounting play capable of allowing the positioning of the insulating blocks in a position in which a threaded stud is housed in each of the cylindrical wells 30. Such oblong recesses 37 are particularly advantageous when the angle arrangement 12 is pre-assembled in the workshop and the insulating blocks 30, 31 of each pair are fixed to one another when they are mounted on the supporting structure 3.

Figure 3:
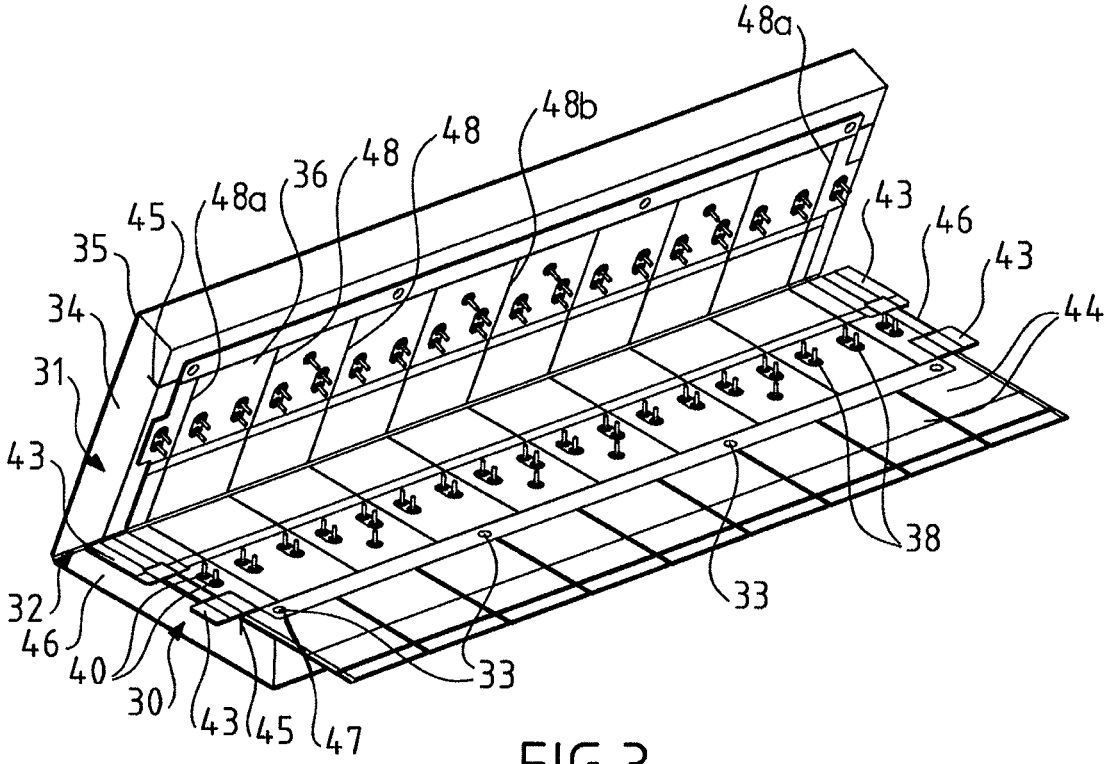
FIG. 3 is a perspective view illustrating insulating blocks of an angle arrangement placed at the intersection between two walls of the tank and forming a corner of the secondary thermally insulating barrier.
Figure 4:
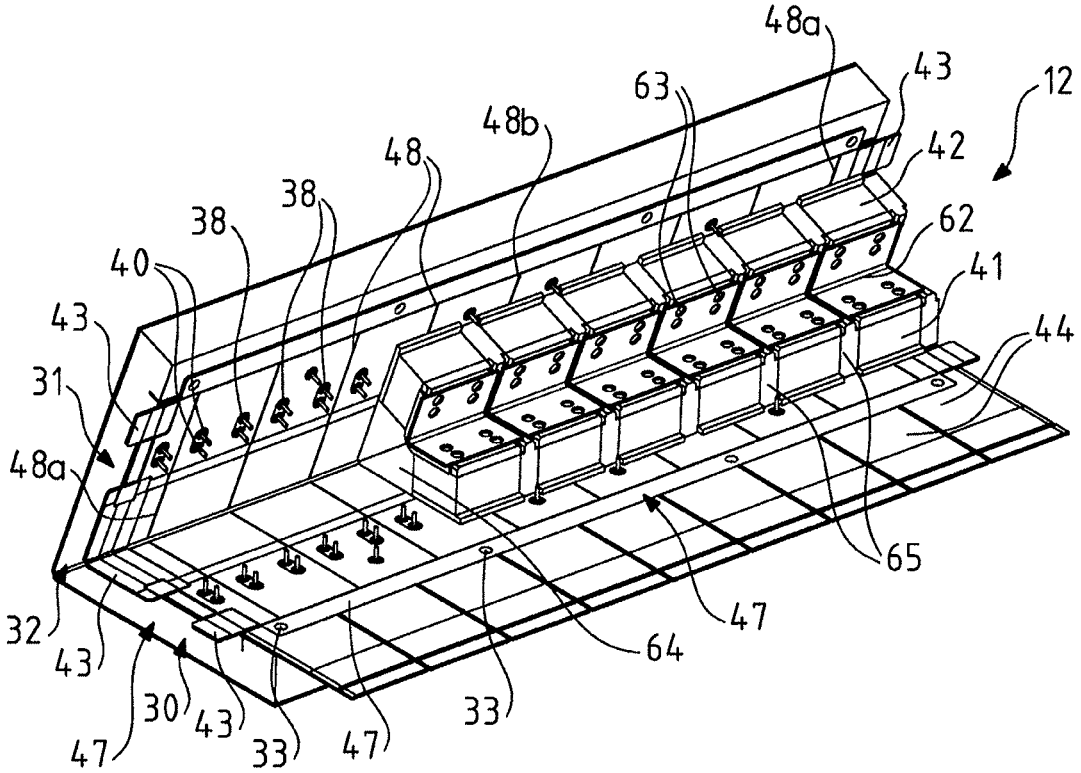
FIG. 4 is a perspective partial view of the angle arrangement of FIG. 3 and illustrating insulating blocks forming a corner of the secondary thermally insulating barrier and a corner of the primary thermally insulating barrier.

Each of the insulating blocks 30, 31 is equipped with a plurality of metal plates 38, represented in FIGS. 3 and 4, intended to anchor the metal angle structure of the secondary sealing membrane 6. The metal plates 38 are spaced apart from one another along the edge 4 of the angle. The metal plates 38 are received in voids 39, represented in particular in FIGS. 5 to 7, such that the inner surface of the metal plates 38 is flush with the inner surface of the inner sheet 36. The metal plates 38 are fixed onto the inner sheet 36 or onto the layer of insulating foam 34 of said insulating blocks 30, 31, for example by means of screws, staples or rivets.

Each of the metal plates 38 is also equipped with a pair of threaded studs 40 protruding toward the interior of the tank and intended to ensure the fixing of the insulating blocks 41, 42 of the primary thermally insulating barrier 7.

Moreover, the inner sheet 36 of the insulating blocks 30, 31 has, along its lateral edges 46 at right angles to the edge 4, on the one hand, and along its edge 47 parallel and opposite to said edge 4, on the other hand, a setback receiving bridging plates 43, 44. Thus, on the one hand, bridging plates 43 are placed straddling two adjacent insulating blocks 30, 31 along the edge 4 of the angle so as to oppose a separation between the insulating blocks 30, 31 that are adjacent in a direction parallel to the edge 4. On the other hand, bridging plates 44 are placed straddling each insulating block 30, 31 and one or more adjacent insulating panels 9, by spanning the interstice between the insulating block 30, 31 and the adjacent insulating panel(s) 9. Such bridging plates 44 thus make it possible to oppose a separation, in a direction at right angles to the edge, between the insulating blocks 30, 31 and the insulating panels 9 running along the angle arrangement 12.

Each of the insulating blocks 30, 31 of the angle arrangement 12 has a stress-relief slot 45 which extends, in a direction parallel to the edge 4, between the metal plates 38 and the edge 47 of the bridging plates 44. The stress-relief slot 45 extends from one end to the other of the insulating block 30, 31 over its entire length. The stress-relief slot 45 is formed through the inner sheet 36 and through a top portion of the layer of insulating polymer foam 34. The depth of the stress-relief slot 45 lies between 1 and 10 cm, for example of the order of 5 cm. The stress-relief slot 45 makes it possible to reduce the stresses that are exerted on the insulating blocks 30, 31 by virtue, on the one hand, of the presence of the bridging elements 44 which are fixed straddling the insulating block 30, 31 and an adjacent insulating panel 9 and preventing the mutual separation thereof when the tank is made cold and, on the other hand, contraction of the metal angle structure of the secondary sealing membrane 6 which is anchored onto the insulating blocks 30, 31.

Moreover, each of the insulating blocks 30, 31 of the angle arrangement 12 comprises a series of stress-relief slots 48 at right angles to the edge 4 which are formed on the inner face of said insulating block 30, 31 through the inner sheet 35 and an inner portion of the layer of insulating polymer foam 35. The stress-relief slots 48 are evenly distributed along the edge 4. Each stress-relief slot 48 is situated between two of the metal plates 38 intended for the anchoring of the metal angle structure of the secondary sealing membrane 6.

The stress-relief slots 48 extend at right angles to the edge 4, from the beveled edge 32 of the insulating block 30, 31 to join the stress-relief slot 45 parallel to the edge 4.

In the embodiment represented, two metal plates 38 are placed in each interval between two adjacent stress-relief slots 48 and a single metal plate 38 is placed between each of the end stress-relief slots **48*a* and the adjacent side edge 46 of the insulating block 30, 31**.

Figure 8:
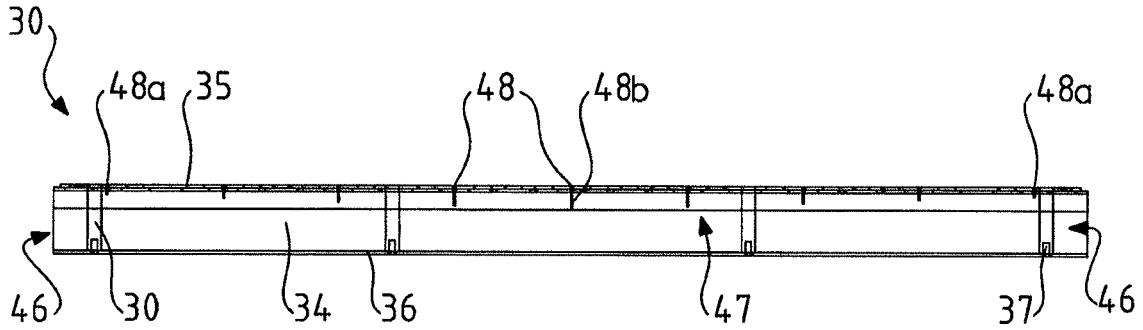
FIG. 8 is a front view of the insulating block of FIGS. 6 and 7 represented as transparent.
Figure 9:
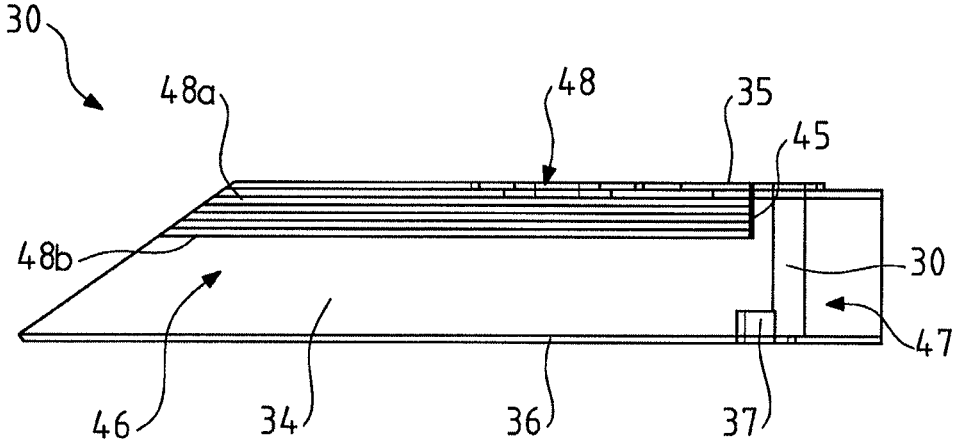
FIG. 9 is a side view of the insulating block of FIGS. 6 to 8, represented as transparent.

In relation to FIGS. 8 and 9, it can be observed that the stress-relief slots 38 at right angles to the edge have depths that are different from one another. The depth of the stress-relief slots 48 decreases from the central stress-relief slot **48*b* to the end stress-relief slots 48*a*, that is to say when moving away from the center of the insulating block 30, 31 to approach one or other of the side edges 46, which makes it possible to reduce the flexibility of the panel on its edges and increase it toward its central zone. Thus, a better distribution of the stresses in the insulating block 30, 31** is obtained.

As an example, the depth of the stress-relief slots 48 at right angles to the edge 4 can vary between a dimension lying between approximately 5 and 12 cm for the central stress-relief slot 48*b*, that is to say the deepest, and a dimension lying between 2 and 6 cm for the end stress-relief slots 48*a*, that is to say the least deep.

In FIG. 2, the metal angle structure ensuring the sealing of the second sealing membrane 6 at the intersection between two walls 1, 2 is partially represented.

In the embodiment represented, the metal angle structure comprises one or more L-shaped angle irons 49 placed at the intersection between the two insulating blocks 30, 31 and, for each angle iron 49, two metal strips 50, 51 which are respectively welded to one and the other of the ends of said angle iron 49 (a part of the metal strips 50 has not been represented in FIG. 2). The metal strips 50, 51 are welded onto the metal plates 38 of the insulating blocks 30, 31 and thus ensure the anchoring of the angle structure on the insulating blocks 30, 31 of the angle arrangement 12.

It can thus be observed that the metal angle structure has two wings which are here formed by the metal strips 50, 51 and rest respectively against an insulating block 30 placed against the first wall 1 and an insulating block 31 placed against the second wall 2. The metal angle structure has no corrugations. In other words, the metal structure comprises two substantially planar wings respectively parallel to one and the other of the two adjacent walls 1, 2.

The metal strips 50, 51 are provided with orifices for the passage of the studs 40. So as to ensure the sealing of the secondary sealing membrane 6, the metal strips 50, 51 are welded to the metal plates 38, at the periphery of said orifices.

The angle irons 49 and the metal strips 50, 51 are lap-welded one after the other. Moreover, the edges of the corrugated metal sheets 28 are welded to the metal strips 50, 51 in order to ensure the continuity of the sealing of the secondary sealing membrane 6. The closure of each of the corrugations 24, 25 is ensured by a cap 52 which is welded straddling one of the metal strips 50, 51 and one of the corrugated metal sheets 28.

In another alternative embodiment not represented, the metal angle iron 49 is welded onto the metal plates 38 and has orifices for the passage of the studs 40 whereas the two metal strips 50, 51 are welded onto one and the other of the ends of said angle iron 49 in order to ensure the anchoring of the metal strips 50, 51 on the insulating blocks 30, 31.

The metal angle structure is advantageously produced in Invar®: that is to say an alloy of iron and of nickel whose coefficient of expansion typically lies between $1.2.10^{-6}$ and $2.10^{-6}$ $K^{-1}$, or in an alloy of iron with high manganese content whose coefficient of expansion is typically of the order of $7.10^{-6}$ $K^{-1}$.

Returning to FIG. 1, the structure of the primary thermally insulating barrier 7 and of the primary sealing membrane 8 is described hereinbelow.

The primary thermally insulating barrier 7 comprises a plurality of insulating panels 53 of substantially rectangular parallelepipedal form. The insulating panels 53 each have dimensions substantially equal to the dimensions of an insulating panel 57, 58 of the second thermally insulating barrier 5, apart from the thickness which can be different, preferably smaller than that of an insulating panel 57, 58. The insulating panels 53 are here offset in relation to the insulating panels 57, 58 of the secondary thermally insulating barrier 5 such that each insulating panel 53 extends over four insulating panels 57, 58 of the secondary thermally insulating barrier 5.

The insulating panels 53 comprise a structure similar to that of the insulating panels 57, 58 of the secondary thermally insulating barrier 5, namely a sandwich structure made up of a layer of insulating polymer foam sandwiched between two rigid sheets, for example of plywood.

In another embodiment not represented, the insulating panels 53 comprise a sandwich structure having three rigid panels, for example of plywood, and two layers of polymer foam which are each inserted in a respective interval between two of the rigid panels.

The outer sheet of the insulating panels 53 has two series of grooves, not illustrated, intended to receive the corrugations 24, 25 of the secondary sealing membrane 6 which protrude toward the interior of the tank.

The inner sheet of an insulating panel 53 of the primary thermally insulating barrier 7 is equipped with metal plates 54 for anchoring the corrugated metal sheets 55 of the primary sealing membrane 8. The metal plates 54 extend in two right-angled directions which are each parallel to two opposite edges of the insulating panels 53. The metal plates 54 are fixed in voids formed in the inner sheet of the insulating panel 53 and fixed thereto, by screws, rivets or staples.

Moreover, the inner sheet of the insulating panel 53 is provided with a plurality of stress-relief slots 56 allowing the primary sealing membrane 8 to be deformed without imposing excessive mechanical stresses on the insulating panels 53. Such stress-relief slots 56 are notably described in the document FR 3001945.

The fixing of the insulating panels 53 of the primary thermally insulating barrier 7 onto the insulating panels 9, 57, 58 of the secondary thermally insulating barrier 5 is ensured by means of the threaded studs 59. For this, each insulating panel 53 comprises a plurality of cutouts along its edges and at its corners, into which a threaded stud 59 extends. The outer sheet of the insulating panels 53 overlaps into the cutouts so as to form a bearing surface for a retaining member which comprises a threaded bore threaded onto each threaded stud 59. The retaining member comprises lugs housed inside the cutouts and coming to bear against the portion of the outer sheet overshooting into the cutout so as to sandwich the outer sheet between a lug of the retaining member and an insulating panel 9, 57, 58 of the secondary thermally insulating barrier 6 and thus ensure the fixing of each insulating panel 53 onto the insulating panels 9, 57, 58 that it spans.

The primary sealing membrane 8 is obtained by assembling a plurality of corrugated metal sheets 55. Each corrugated metal sheet 55 comprises a first series of parallel corrugations and a second series of parallel corrugations extending in a second direction at right angles to the first series. The corrugations protrude toward the interior of the tank. The corrugated metal sheets 55 are, for example, produced in stainless steel or in aluminum.

As mentioned in relation to the insulating panels 9 of the secondary thermally insulating barrier 5 and the corrugated metal sheets 28 of the secondary sealing membrane, the insulating panels 60 of the primary thermally insulating barrier 7 and the corrugated metal sheets 61 of the primary sealing membrane 8 which edge the angle arrangement 12 can comprise, depending on the form of the wall 1, 2 to be covered, a substantially rectangular form, or a generally right-angled triangle or right-angled trapezoid form.

In relation to FIG. 4, the structure of the primary thermally insulating barrier 7 can be observed at the angle arrangement 8. The primary thermally insulating barrier 7 comprises a plurality of pairs of pre-assembled insulating blocks 41, 42 of which one is anchored onto the studs 40 protruding from an insulating block 30 fixed against one of the walls 1, 2 and of which the other is anchored on the studs 40 of an insulating block 31 fixed against the other of the walls 1, 2. The insulating blocks 41, 42 have an inner face on which rests a bracket 62 and an outer face resting against the metal angle structure, not illustrated in FIG. 4, forming the corner of the secondary sealing membrane 6. The insulating blocks 41, 42 also have a sandwich structure and comprise a layer of insulating polymer foam sandwiched between two sheets of plywood glued onto said layer of polymer foam.

The brackets 62 are metal brackets, for example, produced in stainless steel. The brackets 62 each have two wings resting respectively against the inner face of one and the other of the insulating blocks of a pair of insulating blocks 41, 42. Each wing of a bracket 62 has studs, not illustrated, which are welded onto the outer face of said wing and protrude toward the exterior of the tank and thus make it possible to fix the bracket onto the insulating blocks 41, 42. For this, said insulating blocks 41, 42 comprise orifices, not illustrated, which allow the passage of the studs and are formed on their inner face. The orifices communicate with cylindrical wells emerging on the outer face of the insulating blocks 41, 42. Nuts screwed onto the studs bear against the bottom of the cylindrical wells and thus ensure the securing of the bracket 62 to said insulating blocks 41, 42. The bracket 62 thus makes it possible to link the insulating blocks 41, 42 two-by-two so as to form modules pre-assembled in the workshop.

In order to ensure the fixing of the insulating blocks 41, 42 to the insulating blocks 30, 31 of the secondary thermally insulating barrier 5, cylindrical wells 63 are formed through the bracket 62 and the insulating blocks 41, 42. The cylindrical wells 63 each communicate with an orifice for the passage of a threaded stud 40 formed in the outer face of one of the insulating blocks 41, 42. Each cylindrical well 63 has a diameter greater than that of the orifice through which passes the threaded stud 40 with which it cooperates such that the bottom of the cylindrical well 63 defines a bearing surface intended to cooperate with a nut screwed onto the threaded stud 40.

Moreover, an angle coupling 64 made of insulating material, such as a polymer foam, is placed between the adjacent edges at the tank angle of the two insulating blocks 41, 42 and thus makes it possible to ensure a continuity of the thermal insulation at the angle of the tank. According to an advantageous embodiment, the pre-assembled modules comprise, in addition to the pair of insulating blocks 41, 42 and the bracket 62, an angle coupling 64.

Furthermore, joining insulating elements 65 are inserted between two pairs of adjacent insulating blocks 41, 42 so as to ensure a continuity of the thermal insulation.

Figure 10:
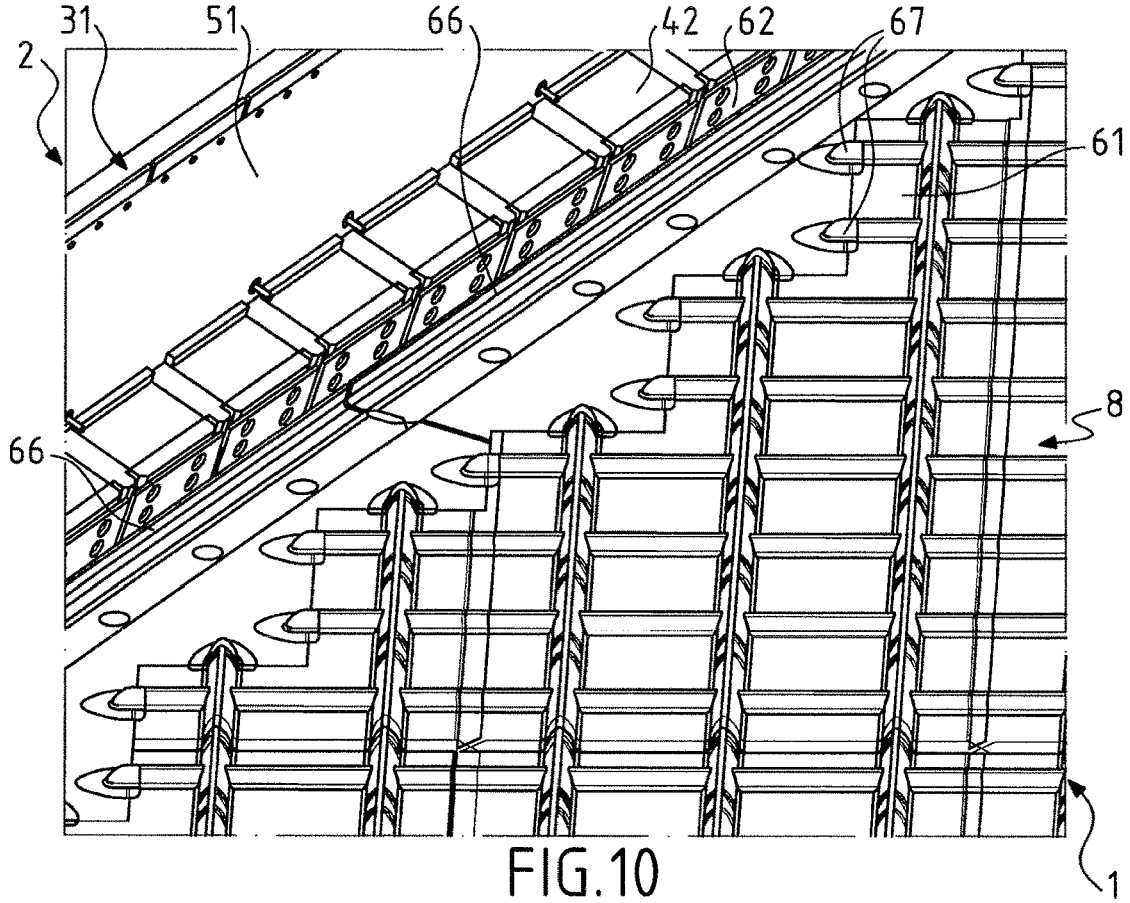
FIG. 10 is a perspective cutaway view of the primary thermally insulating barrier and of the primary sealing membrane at an angle arrangement placed at the intersection between two walls.

In relation to FIG. 10, the metal angle structure ensuring the sealing of the primary metal membrane 8 at the intersection between two insulating blocks 41, 42 will be described hereinbelow. The metal angle structure comprises one or more L-shaped angle irons 66 placed at the intersection between the two walls 1, 2 and for each metal angle iron 66, two metal strips not represented. The metal angle irons 62 are lap-welded one after the other. Furthermore, each metal angle iron 66 is welded onto a plurality of brackets 62. The metal strips are each lap-welded onto the metal angle irons 66. Moreover, the edges of the corrugated metal sheets 61 are welded onto the metal strips in order to ensure the continuity of the sealing of the primary sealing membrane 8. The closure of each of the corrugations is ensured by a cap 67 which is welded straddling one of the metal strips and one of the corrugated metal sheets 61.

The technique described above for producing a sealed and thermally insulating tank for storing a fluid can be used in different types of storage reservoirs, for example to form an LNG storage reservoir in an onshore installation or in a floating structure like a methane ship or similar.

Figure 11:
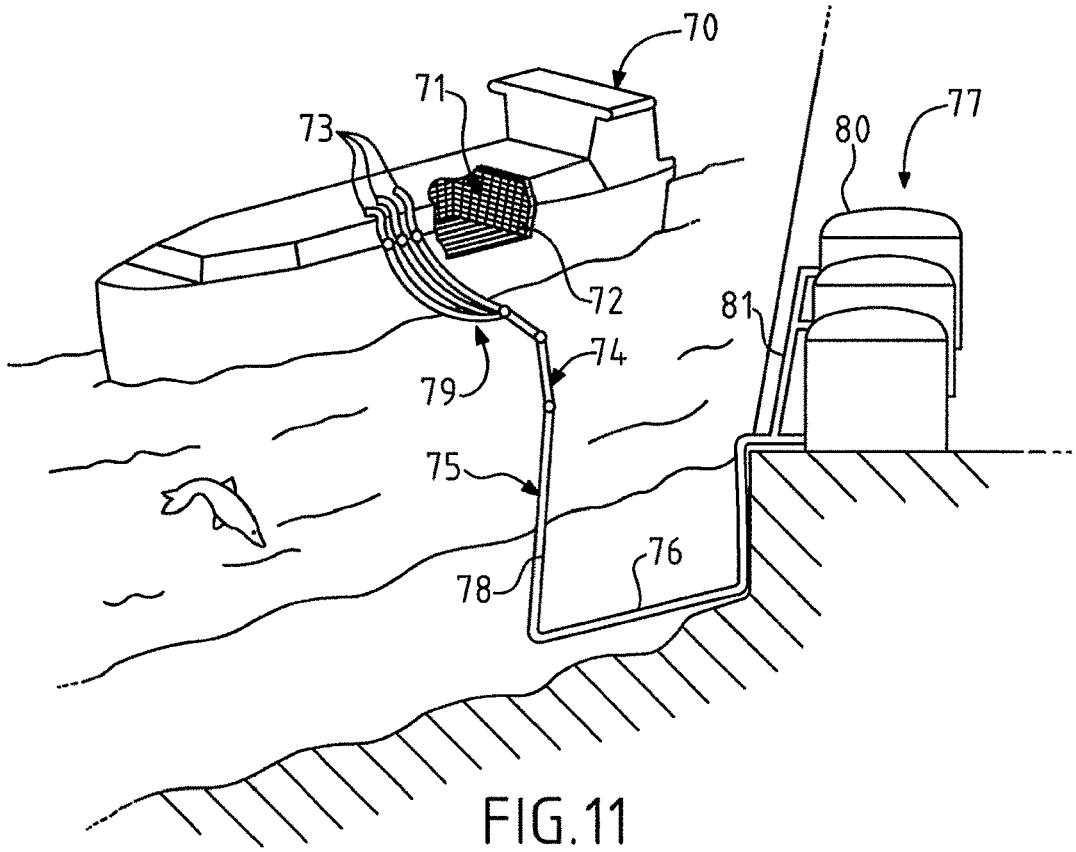
FIG. 11 is a cutaway schematic representation of a methane tanker tank and of a terminal for loading/offloading this tank.

Referring to FIG. 11, a cutaway view of a methane ship 70 shows a sealed and insulated tank 71 of generally prismatic form mounted in the double hull 72 of the ship. The wall of the tank 71 comprises a primary sealed barrier intended to be in contact with the LNG contained in the tank, a secondary sealed barrier arranged between the primary sealed barrier and the double hull 72 of the ship, and two insulating barriers arranged respectively between the primary sealed barrier and the secondary sealed barrier and between the secondary sealed barrier and the double hull 72.

As is known per se, loading/offloading pipelines 73 placed on the top deck of the ship can be connected, by means of appropriate connectors, to a maritime or port terminal to transfer an LNG cargo from or to the tank 71.

FIG. 11 represents an example of maritime terminal comprising a loading and offloading station 75, a submarine pipe 76 and an onshore installation 77. The loading and offloading station 75 is a fixed offshore installation comprising a mobile arm 72 and a riser 78 which supports the mobile arm 74. The mobile arm 74 supports a bundle of insulated flexible pipes 79 that can be connected to the loading/offloading pipelines 73. The orientable mobile arm 74 adapts to all methane tanker templates. A link pipe not represented extends inside the riser 78. The loading and offloading station 75 allows the loading and the offloading of the methane tanker 70 from or to the onshore installation 77. The latter comprises liquefied gas storage tanks 80 and link pipes 81 linked by the submarine pipe 76 to the loading or offloading station 75. The submarine pipe 76 allows the transfer of the liquefied gas between the loading or offloading station 75 and the onshore installation 77 over a great distance, for example 5 km, which makes it possible to keep the methane tanker 70 at a great distance from the coast during the loading and offloading operations.

To generate the pressure necessary for the transfer of the liquefied gas, pumps embedded in the ship 70 and/or pumps with which the onshore installation 77 is equipped and/or pumps with which the loading and offloading station 75 is equipped are implemented.

Although the invention has been described in relation to several particular embodiments, it is quite obvious that it is in no way limited thereto and that it comprises all the technical equivalents of the means described as well as the combinations thereof provided that the latter fall within the scope of the invention.

The use of the verb "comprise" or "include" and its conjugate forms does not exclude the presence of elements or steps other than those described in a claim. The use of the indefinite article "a" or "an" for an element or a step does not exclude, unless otherwise stipulated, the presence of a plurality of such elements or steps.

In the claims, any reference symbol between parentheses should not be interpreted as a limitation on the claim.

The invention claimed is:

1. A sealed and thermally-insulating fluid storage tank comprising at least one thermally insulating barrier (5) retained on a supporting structure (3) and a sealing membrane (6) supported by said thermally insulating barrier (5), the thermally insulating barrier (5) comprising a plurality of insulating panels (9, 57, 58) retained on the supporting structure (3) and juxtaposed against at least one first and one second adjacent walls (1, 2) of the supporting structure (3); the tank further comprising an angle arrangement (12) placed at an intersection (4) between the first and the second adjacent walls (1, 2) and comprising:

a first and a second insulating blocks (30, 31) respectively retained on the first and second adjacent walls (1, 2) of the supporting structure and forming a corner of the thermally insulating barrier (5); each of the first and second insulating blocks (30, 31) comprising an outer face placed facing the supporting structure (3) and an inner face comprising metal plates (38) spaced apart from one another along the intersection between the first and the second adjacent walls (1, 2); said first and second insulating blocks (30, 31) comprising a layer of polymer foam (34); and a metal angle structure (49, 50, 51) forming a corner of the sealing membrane (6) and comprising a first and a second wings which are respectively welded onto the metal plates (38) of the first and second insulating blocks (30, 31);

each of the first and second insulating blocks (30, 31) being associated with an adjacent panel (9) of the plurality of insulating panels (9, 57, 58) via a bridging element (44); said bridging element (44) being fixed straddling an edge (47), parallel to the intersection (4), of the inner face of said first or second insulating block (30, 31) and an inner face of the adjacent panel (9), so as to oppose a mutual separation of said first or second insulating block (30, 31) and of said adjacent panel (9), said bridging element being placed between the sealing membrane (6) and the supporting structure (3);

each of the first and second insulating blocks (30, 31) having at least one first and one second stress-relief slots (45, 48) formed in the inner face of said first or second insulating block (30, 31) in the thickness of the layer of polymer foam (34); the first stress-relief slot (45) extending parallel to the intersection (4), said first stress-relief slot (45) being situated so as to pass between the edge (47) of the inner face of the insulating block (30, 31) receiving the bridging element (44) and the metal plates (38) of said insulating block (30, 31); the second stress-relief slot (48) extending at right angles to the intersection (4), said second stress-relief slot (45) being situated so as to pass between two of the metal plates (38) of said insulating block (30, 31).

2. The tank as claimed in claim 1, in which the bridging elements are bridging plates (44) which each have an outer face resting against the inner face of the first or of the second insulating block (30, 31) and the inner face of the adjacent panel (9) and an inner face supporting the sealing membrane (6).

3. The tank as claimed in claim 1, in which each of the first and second insulating blocks (30, 31) comprises a series of second stress-relief slots (48) extending at right angles to the intersection between the first and the second adjacent walls (1, 2), each of said second stress-relief slots (48) being situated in a respective interval between two of the metal plates (38) of said insulating block (30, 31).

4. The tank as claimed in claim 3, in which the series of second stress-relief slots (48) extending at right angles to the intersection comprises at least one central second stress-relief slot (48*b*) and two end second stress-relief slots (48*a*) which extend on either side of the central second stress-relief slot (48*b*), the central second stress-relief slot (48*b*) having a depth greater than that of each of the end stress-relief slots (48*b*).

5. The tank as claimed in claim 1, in which the or each second stress-relief slot (48) extending at right angles to the intersection extends from an edge (32) of the insulating block which is adjacent to the intersection to the first stress-relief slot (45).

6. The tank as claimed in claim 1, in which the first and the second insulating blocks (30, 31) are respectively retained on the first and the second adjacent walls (1, 2) of the supporting structure (3) by means of a plurality of threaded studs fixed to the supporting structure (3), each of said first and second insulating blocks (30, 31) being provided with cylindrical wells (33), each threaded stud being anchored in one of the the cylindrical wells (33); said cylindrical wells (33) being formed along the edge (47) of said each of said first and second insulating blocks (30, 31) adjacent to an insulating panel (9).

7. The tank as claimed in claim 1, in which the metal angle structure comprises an angle iron (49) and a pair of metal strips (50, 51) lap-welded with the angle iron (49), one of the angle iron (49) and the pair of metal strips (50, 51) being welded onto the metal plates (38) of the first and of the second insulating blocks (30, 31).

8. The tank as claimed in claim 1, in which the wings of the metal angle structure (49, 50, 51) are planar.

9. The tank as claimed in claim 1, in which the plurality of insulating panels (9, 57, 58) have an inner face equipped with metal plates (16, 17), in which the sealing membrane (6) comprises a plurality of corrugated metal sheets (18, 28) which are welded onto the metal plates (16, 17) of the insulating panels (9, 57, 58) and in which the metal angle structure (49, 50, 51) is connected by tight welding to the corrugated metal sheets (16, 17).

10. The tank as claimed in claim 1, in which the thermally insulating barrier is a secondary thermally insulating barrier (5) and the sealing membrane is a secondary sealing membrane (6), the tank further comprising a primary thermally insulating barrier (7) anchored to the second thermally insulating barrier (5) by retaining members (19) and a primary sealing membrane (8) supported by the primary thermally insulating barrier (7) and intended to be in contact with the fluid contained in the tank.

11. The tank as claimed in claim 10, in which the angle arrangement (12) comprises primary insulating blocks (41, 42) forming a corner of the primary thermally insulating barrier (7) which are each retained against one or other of the first and second insulating blocks (30, 31) by means of studs (40) supported by the metal plates (38) of the first and second insulating blocks (30, 31).

12. The tank as claimed in claim 11, in which the metal angle structure (49, 50, 51) comprises orifices through which pass the studs (40) supported by the metal plates (38) of the first and second insulating blocks (30, 31), the metal angle structure (49, 50, 51) being welded to said metal plates (38) at the periphery of said orifices.

13. A ship (70) for transporting a fluid, the ship comprising a hull (72) and a tank (71) as claimed in claim 1 placed in the hull.

14. A method for loading or offloading a ship (70) as claimed in claim 13, in which a fluid is routed through insulated pipelines (73, 79, 76, 81) from or to a floating or onshore storage installation (77) to or from the tank of the ship (71).

15. A transfer system for a fluid, the system comprising a ship (70) as claimed in claim 13, insulated pipelines (73, 79, 76, 81) arranged so as to link the tank (71) installed in the hull of the ship to a floating or onshore storage installation (77) and a pump for driving a flow of fluid through the insulated pipelines from or to the floating or onshore storage installation to or from the tank of the ship.

* * * * *